US009002248B2

(12) United States Patent
Ishii et al.

(10) Patent No.: US 9,002,248 B2
(45) Date of Patent: Apr. 7, 2015

(54) FUSER DEVICE AND IMAGE FORMING APPARATUS PROVIDED WITH SAME

(71) Applicant: KYOCERA Document Solutions Inc., Osaka (JP)

(72) Inventors: Satoshi Ishii, Osaka (JP); Shogo Usui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 61 days.

(21) Appl. No.: 13/774,142

(22) Filed: Feb. 22, 2013

(65) Prior Publication Data

US 2013/0216284 A1 Aug. 22, 2013

(30) Foreign Application Priority Data

Feb. 22, 2012 (JP) ..... 2012-036583

(51) Int. Cl.
*G03G 15/20* (2006.01)
*G03G 13/20* (2006.01)

(52) U.S. Cl.
CPC ..... *G03G 13/20* (2013.01); *G03G 15/2053* (2013.01)

(58) Field of Classification Search
CPC ..... G03G 15/2053
USPC ..... 399/328, 329, 330
See application file for complete search history.

(56) References Cited

U.S. PATENT DOCUMENTS

| | | | | |
|---|---|---|---|---|
| 6,872,925 | B2 * | 3/2005 | Asakura et al. | 399/328 X |
| 6,954,608 | B2 * | 10/2005 | Sekiguchi et al. | 399/328 X |
| 7,266,336 | B2 * | 9/2007 | Ueno et al. | 399/329 |
| 7,369,804 | B2 * | 5/2008 | Yasuda et al. | 399/330 |
| 7,764,916 | B2 * | 7/2010 | Kagawa | 399/330 X |
| 8,055,174 | B2 * | 11/2011 | Yoshikawa | 399/329 |
| 8,314,372 | B2 * | 11/2012 | Yoshihara et al. | 399/328 X |
| 2009/0142114 | A1 | 6/2009 | Yasuda et al. | |
| 2009/0245897 | A1 | 10/2009 | Seo et al. | |

FOREIGN PATENT DOCUMENTS

| | | | |
|---|---|---|---|
| JP | 2001-230065 | A | 8/2001 |
| JP | 2002221864 | A | 8/2002 |
| JP | 2009230070 | A | 10/2009 |
| WO | 2006054658 | A1 | 5/2006 |

OTHER PUBLICATIONS

Patent Abstracts of Japan, Publication No. 2002-221864, dated Aug. 9, 2002; downloaded Jun. 11, 2013.
English Abstract and Translation for JP 2001-230065 A, published Aug. 24, 2001.

* cited by examiner

*Primary Examiner* — Sandra Brase
(74) *Attorney, Agent, or Firm* — NDQ&M Watchstone LLP

(57) ABSTRACT

A magnetic core surrounds a coil and has a plurality of first core sections arrayed along the widthwise direction of a recording medium orthogonally to the conveyance direction of the recording medium, and a second core section disposed at both ends in the widthwise direction within a hollow section of the coil. The second core section is formed so that the cross-sectional area thereof in the conveyance direction of the recording medium grows progressively larger from the center of the widthwise direction towards the end thereof.

8 Claims, 12 Drawing Sheets

30

FUSER DEVICE AND IMAGE FORMING APPARATUS PROVIDED WITH SAME

INCORPORATION BY REFERENCE

This application is based on and claims the benefit of priority from Japanese Patent Application No. 2012-036583 filed on Feb. 22, 2012, the contents of which are hereby incorporated by reference.

BACKGROUND

The present disclosure relates to a fuser device and an image forming apparatus provided with the same, and in particular to a fuser device utilizing electromagnetic induction heating and an image forming apparatus provided with the same.

A fuser device utilizing electromagnetic induction heating is provided with, for example, a heating member, a pressure-applying member pressed against the heating member, a magnetic core having a predetermined Curie temperature, and a coil for generating a magnetic flux using the magnetic core to inductively heat the heating member. The fuser device generates an eddy current in an inductive heat-generating layer provided within the heating member via the magnetic core using the magnetic flux generated by the coil, generates heat in the heating member using joule heat generated by the eddy current, and heats the heating member to a predetermined fusing temperature.

The coil is, for example, looped around the beating member along the lengthwise direction thereof, and the magnetic core extends along the paper widthwise direction (that is, lengthwise direction of the magnetic core) in the gap formed by the rings of the looped coil. The coil is configured so that, for example, an inner part of a U-shaped mapping part at the end of the lengthwise direction of the coil roughly corresponds to the end of the maximum paper width subjected to fusing. Such a configuration may suitably dispose the coil with respect to the heating member provided with the inductive heat-generating layer, and enables uniform heating along the paper widthwise direction.

SUMMARY

A fuser device according to an aspect of the present disclosure is provided with a heating member; a pressure-applying member pressed against the heating member, a mp, formed by the heating member and the pressure-applying member, and configured to clamp a recording medium bearing an unfused toner image and melting and losing the unfused toner image on fee recording medium; a coil for generating a magnetic flux for inductively heating the heating member looped around the heating member in the lengthwise direction thereof; and a magnetic core, disposed near the coil in the widthwise direction of the recording medium orthogonally to the conveyance direction of the recording medium, and configured to guide the magnetic flux to an inductive heat-generating layer of the healing member. The magnetic core is provided with a first core section surrounding the coil and disposed along the widthwise direction, and a second core section disposed at both ends in the widthwise direction within the hollow area which the loop of the coil forms, the second core section being formed so that the cross-sectional area thereof in the conveyance direction of the recording medium grows progressively larger from the center of the widthwise direction towards the end thereof.

Objects of the present disclosure and specific advantages of the present disclosure will become apparent from the description of embodiments given below.

DETAILED DESCRIPTION

Figure 1:
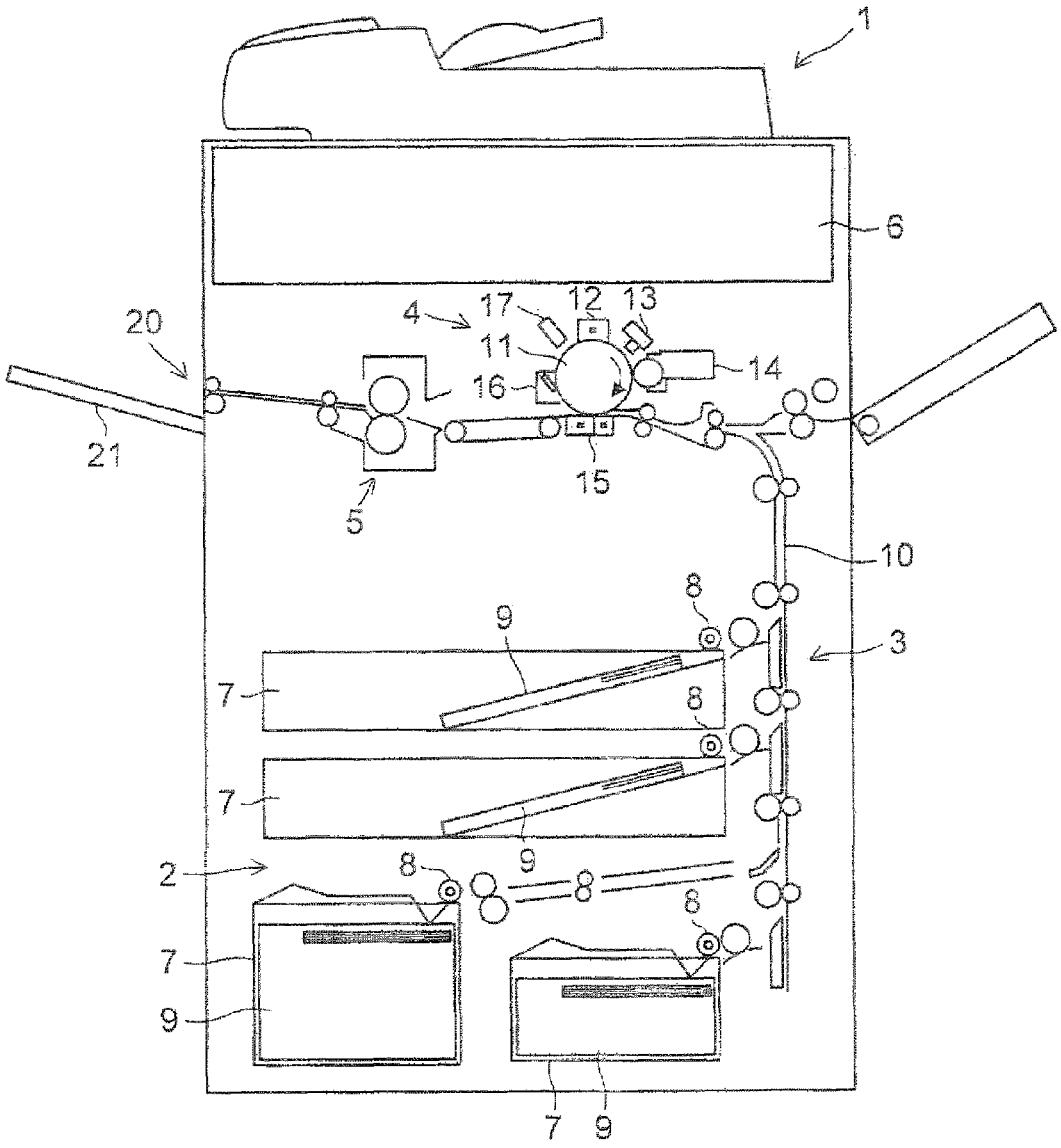
FIG. 1 is a schematic view of an image forming apparatus provided with a fuser device according to a first embodiment of the present disclosure.

Embodiments of the present disclosure are described below while referring to the drawings, but the present disclosure is not restricted to the following embodiments. The application of the disclosure and the terms and the like indicated herein are not restricted to the following.

First Embodiment

FIG. 1 is a schematic view of an image forming apparatus provided with a fuser device according to an embodiment of the present disclosure. An image forming apparatus 1 is provided with a paper feeding unit 2 disposed in the lower part thereof, a paper conveying unit 3 disposed to the side of the paper feeding unit 2, an image forming unit 4 disposed above the paper conveying unit 3, a fuser device 5 disposed closer to art output side than the image forming unit 4, and an image scanner unit 6 disposed above the image forming unit 4 and the fuser device 5.

The paper feeding unit 2 is provided with a plurality of paper feeding cassettes 7 for containing paper 9 (as an example of a recording medium), and the rotation of a paper feeding roller 8 sends out one sheet of the paper 9 at a time from a paper feeding cassette 7 selected from among the plurality of paper feeding cassettes 7 to the paper conveying unit 3.

The paper 9 sent out to the paper conveying unit 3 is conveyed toward the image forming unit 4 via a paper conveyance path 10 provided in the paper conveying unit 3. The image forming unit 4 forms a toner image on the paper 9 using an electrophotographic process. The image forming unit 4 is provided with a photoreceptor 11 supported so as to be capable of rotating in the direction of the arrow illustrated in FIG. 1, and an electrostatic unit 12, exposure unit 13, developer unit 14, transfer unit 15, cleaning unit 16, and a static eliminator unit 17 disposed around the photoreceptor 11 in the direction of rotation of the photoreceptor 11.

The electrostatic unit 12 is provided with an electrostatic wire to which a high voltage is applied. A predetermined toner image is applied to the surface of the photoreceptor 11 using corona discharge from the electrostatic wire, thereby uniformly imparting the surface of the photoreceptor 11 with an electrostatic charge. The photoreceptor 11 is then irradiated by the exposure unit 13 with light based on document image data, for example scanned by the image scanner unit 6, selectively attenuating the surface electrical potential of the photoreceptor 11, and forming a latent electrostatic image on the surface of the photoreceptor 11.

The developer unit 14 develops the latent electrostatic image on the surface of the photoreceptor 11, forming a toner image on the surface of the photoreceptor 11. The toner image is transferred by the transfer unit 15 to paper 9 fed between the photoreceptor 11 and the transfer unit 15.

The paper 9 to which the toner image has been transferred is conveyed toward the fuser device 5 disposed at the downstream side in the paper conveyance direction of the image forming unit 4. Heat and pressure are applied to the paper 9 in the fuser device 5, melting and fusing the toner image on the paper 9. The paper 9 to which the toner image has been fused is outputted onto an output tray 21 by an output roller pair 20.

After the toner image has been transferred to the paper 9 by the transfer unit 15, residual toner on the surface of the photoreceptor 11 is removed by the cleaning unit 16, and the residual charge on the surface of the photoreceptor 11 is removed by the static eliminator unit 17. The photoreceptor 11 is then again electrostatically charged by the electrostatic unit 12, and an image is formed in the same manner.

Figure 2:
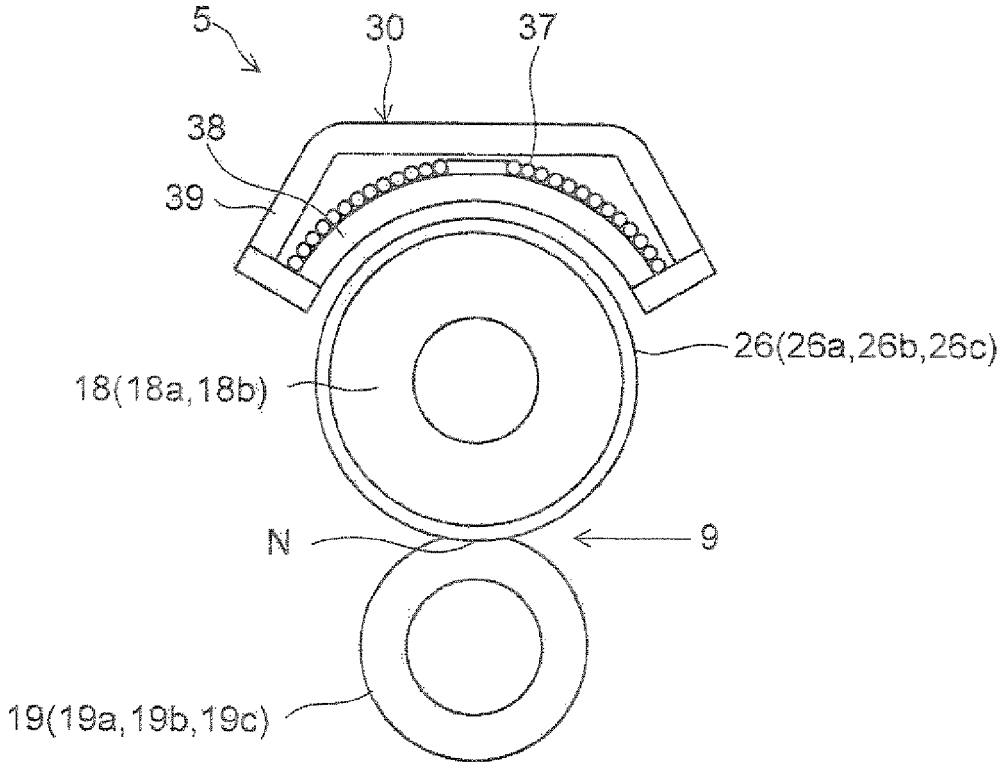
FIG. 2 is a side cross-sectional view of fuser device provided with an inductive heating unit according to the first embodiment of the present disclosure.

The fuser device 5 is configured as shown in FIG. 2. FIG. 2 is a side cross-sectional schematic view of the fuser device 5 according to the present embodiment.

The fuser device 5 performs fusion using electromagnetic induction heating. The fuser device 5 is provided with a heat-generating belt 26 acting as a heating member, a pressure-applying roller 19 acting as a pressure-applying member, a fusing roller 18 integrally attached to the heat-generating belt 26, and an inductive heating unit 30 for supplying a magnetic flux to the heat-generating belt 26. The pressure-applying roller 19 and fusing roller 18 are supported so as to be capable of rotating in the lengthwise direction of a housing (not shown) of the fuser device 5. The inductive heating unit 30 is mounted to and supported by the housing.

The heat-generating belt 26 is an endless heat-resistant belt. The heat-generating belt 26 has, for example, a configuration in which an inductive heat-generating layer 26*a* formed, for example, by using electroformed nickel of a thickness of at least 30 μm and no more than 50 μm, an elastic layer 26*b* of, for example, silicone rubber of a thickness of at least 200 μm and no more than 500 μm, and a mold release layer 26*c* formed using, for example, a fluororesin of a thickness of about 30 μm are layered in that order from the inner circumference side of the belt. The provision of the mold release layer 26*c* allows for improved releasability when the unfused toner image is being melted and fused at the nip N, which is formed at the part where the pressure-applying roller 19 and the heat-generating belt 26 are pressed together.

The fusing roller 18 holds the inner circumference side of the heat-generating belt 26 in a tensed state so as to capable of rotating integrally with the heat-generating belt 26. The fusing roller 18 has a metal core 18*a* of, for example, an aluminum alloy, and an elastic layer 18*b* formed over the metal core 18*a* from, for example, foamed silicone rubber to a thickness of at least 5 mm to no more than 10 mm. The elastic layer 18*b* holds the heat-generating belt 26 in a tensed state.

The outer diameter of the pressure applying roller 19 is, for example, 30 mm. The pressure-applying roller 19 has a cylindrical iron metal core 19*a*, and an elastic layer 19*b* formed over the metal core 19*a* from, for example, foamed silicone rubber to a thickness of at least 2 mm and no more than 5 mm. The pressure-applying roller 19 has an approximately 50 μm-thick mold release layer 19*c* formed over the elastic layer 19*b* from a fluororesin or the like. The pressure-applying roller 19 is rotatably driven by motive power from a motor or the like not shown in the drawings, and the heat-generating belt 26 is driven to rotate by the rotation of the pressure-applying roller 19. At the nip N, heat and pressure are applied to the unfused toner image on the conveyed paper 9, fusing the toner image to the paper 9.

The inductive heating unit 30 is provided with a coil 37, a bobbin 38, and a magnetic core 39, and causes the heat-generating belt 26 to generate heat via electromagnetic induction. The inductive heating unit 30 extends in the lengthwise direction (i.e., the direction proceeding inward from the surface of FIG. 2), and is disposed opposing the heat-generating belt 26 so as to cover roughly half of the outer circumference of the heat-generating belt 26.

The coil 37 is looped a plurality of times along the widthwise direction of the heat-generating belt 26 (the direction proceeding inward from the surface of FIG. 2) and is attached to the bobbin 38. The coil 37 is connected to a power source not shown in the drawings, and generates an AC magnetic flux using high-frequency current supplied from the power source. The magnetic flux from the coil 37 passes through the magnetic core 39, is guided in a direction parallel to the surface of FIG. 2, and passes through the inductive heat-generating layer 26*a* of the heat-generating belt 26. Variations in the AC strength of the magnetic flux passing through the inductive heat-generating layer 26*a* create an eddy current in the inductive heat-generating layer 26*a*. When the eddy current flows through the inductive heat-generating layer 26*a*, joule heat is generated by the electrical resistance of the inductive heat-generating layer 26*a*, and the heat-generating belt 26 generates heat (spontaneously).

When the heat-generating belt 26 is heated to a predetermined temperature, the paper 9 clamped in the nip N is heated and pressure is applied by the pressure-applying roller 19, melting and fusing the powdered toner on the paper 9 to the paper 9. The heat-generating belt 26 is formed from a thin material having good heat conductivity and has a small heat capacity, allowing the fuser device 5 to be warmed up in a short period of time, and quickly initiating image formation.

Figure 3:
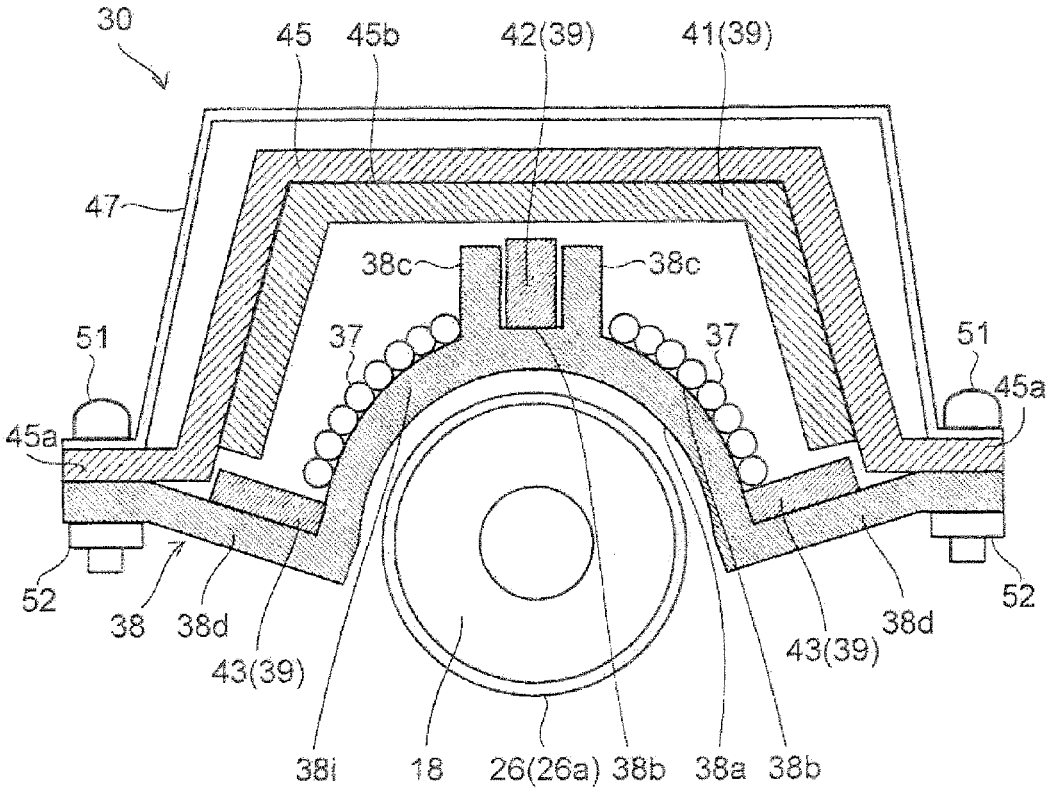
FIG. 3 is a side cross-sectional view of an inductive heating unit according to the first embodiment of the present disclosure.

FIG. 3 shows the configuration of the inductive heating unit 30 in detail FIG. 3 is a side cross-sectional view of the inductive heating unit 30.

The inductive heating unit 30 is provided, as described above, with the coil 37, the bobbin 38 acting as a support member, and the magnetic core 39. The magnetic core 39 has an arched core 41 constituting a first core, an end center core 42 constituting a second core, and a side core 43. The inductive heating unit 30 is further provided with an arched core holder 45, and a cover member 47 for covering the magnetic core 39 and the coil 37. The arched core 41 is attached to the arched core holder 45.

The bobbin 38 is disposed concentrically with the rotational center of the fusing roller 18 at a predetermined spacing from the surface of the heat-generating belt 26. The bobbin 38 has an arcuate portion 38*i* covering roughly half of the circumferential surface of the heat-generating belt 26, and flanges 38*d* extending from both ends of the arcuate portion 38*i*. The arsenate portion 38*i* and the flanges 38*d* constitute the primary frame of the bobbin 38. The arcuate portion 38*i* and the flanges 38*d* have a predetermined thickness so as to allow the strength of the frame to be maintained. The arcuate portion 38*i* and flanges 38*d* are formed from a heat-resistant plastic such as LCP plastic (liquid crystal polymer), PET plastic (polyethylene terephthalate plastic), or PPS plastic (polyphenylene sulfide plastic). Forming the arcuate portion 38*i* and flanges 38*d* from these plastics allows, for example, the resistance thereof to the heat given off by the heat-generating belt 26 to be improved.

The arcuate portion 38*i* of the bobbin 38 has a facing surface 38*a* facing the surface of the heat-generating belt 26 across a predetermined spacing, and an arcuate attachment surface 38*b* positioned on the opposite side front the facing surface 38*a*. A pair of end center cores 42 is attached by adhesive substantially in the center of the attachment surface 38*b*, over a straight line connecting the central rotational axes of the fusing roller 18 and the pressure-applying roller 19 (see FIG. 2). A rising wall 38*c* rising up from the attachment surface 31*b* is formed on the circumference of the end center core 42 so as to extend in the lengthwise direction (i.e., the direction proceeding inward from the surface of FIG. 3). The coil 37 is attached to the attachment surface 38*b*. The surface of the heat-generating belt 26 and the facing surface 38*a* of the bobbin 38 are disposed with a predetermined spacing therebetween. Such a configuration allows contact of the heat-generating belt 26 with the bobbin 38 during rotation of the heat-generating belt 26 to be suppressed.

The coil 37 is formed from a plurality of, for example, enamel wises coated with a melt-fused layer that have been twisted together, an example being AIW wire. The coil 37 is heated in a state of being looped around the lengthwise direction (i.e., the direction proceeding inward from the surface of FIG. 3) in an arcuate manner along the attachment surface 38*b* as seen in cross section to melt the melt-fused layer, then cooled to form a predetermined shape (i.e., a looped shape). Having been solidified in the predetermined shape, the coil 37 is disposed around the rising wall 38*c* of the bobbin 38 and attached to the attachment surface 38*b* by a silicone adhesive or the like.

A plurality of side cores 43 arrayed in the lengthwise direction are attached to the arcuate portion 38*i* side of the flanges 38*d*, 38*d* using an adhesive. The arched core holder 45 is attached to the outside edges of the flanges 38*d*.

The arched core holder 45 has holder flanges 45*a* for attaching to the flanges 38*d* of the bobbin 38, and a plurality of core installation sections 45*b* formed in the lengthwise direction and arching away from the holder flanges 45*a*. An arched core 41 having roughly the same arched shape as the core installation sections 45*b* is attached to the core installation sections 45*b* using an adhesive.

Thus, when the arched core 41 and the end center core 42 and side core 43 are attached to predetermined positions on the arched core holder 45 and the bobbin 38, respectively, the outside of the coil 37 is surrounded by the arched core 41 and the side core 43. The end center core 42 is disposed nearer to the surface of the heat-generating belt 26 than the arched core 41. Furthermore, the coil 37 is surrounded by the surface of the heat-generating belt 26, the side core 43, the arched core 41, and the end center core 42. The magnetic flux generated by the coil 37 due to the high-frequency current being supplied thereto is guided to the side core 43, arched core 41, and end center core 42, and flows along the heat-generating belt 26. At this point, an eddy current is generated in the inductive heat-generating layer 26*a* of the heat-generating belt 26, causing joule heat to be generated in the inductive heat-generating layer 26*a* by the electrical resistance of the inductive heat-generating layer 26*a*, and the heat-generating belt 26 generates heat.

The cover member 47 shields the magnetic flux generated by the inductive heating unit 30. The cover member 47 is constituted by, for example, aluminum sheeting, and covers the area around the coil 37 and the magnetic core 39 from the side opposite to the bobbin 38. The cover member 47 is attached, for example, by layering the holder flanges 45*a* of the arched core holder 45 and the flanges of the cover member 47 in order over the flanges 38*d* of the bobbin 38, then fastening a bolt 51 in place with a nut 52.

Figure 4:
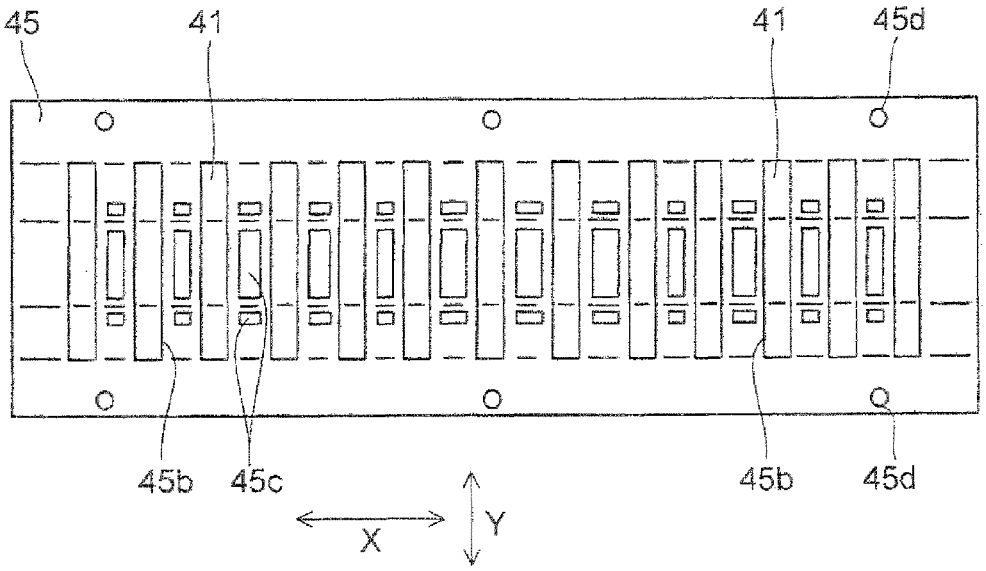
FIG. 4 is a plan view of the disposition of an arched core of an inductive heating unit according to the first embodiment of the present disclosure.
Figure 5:
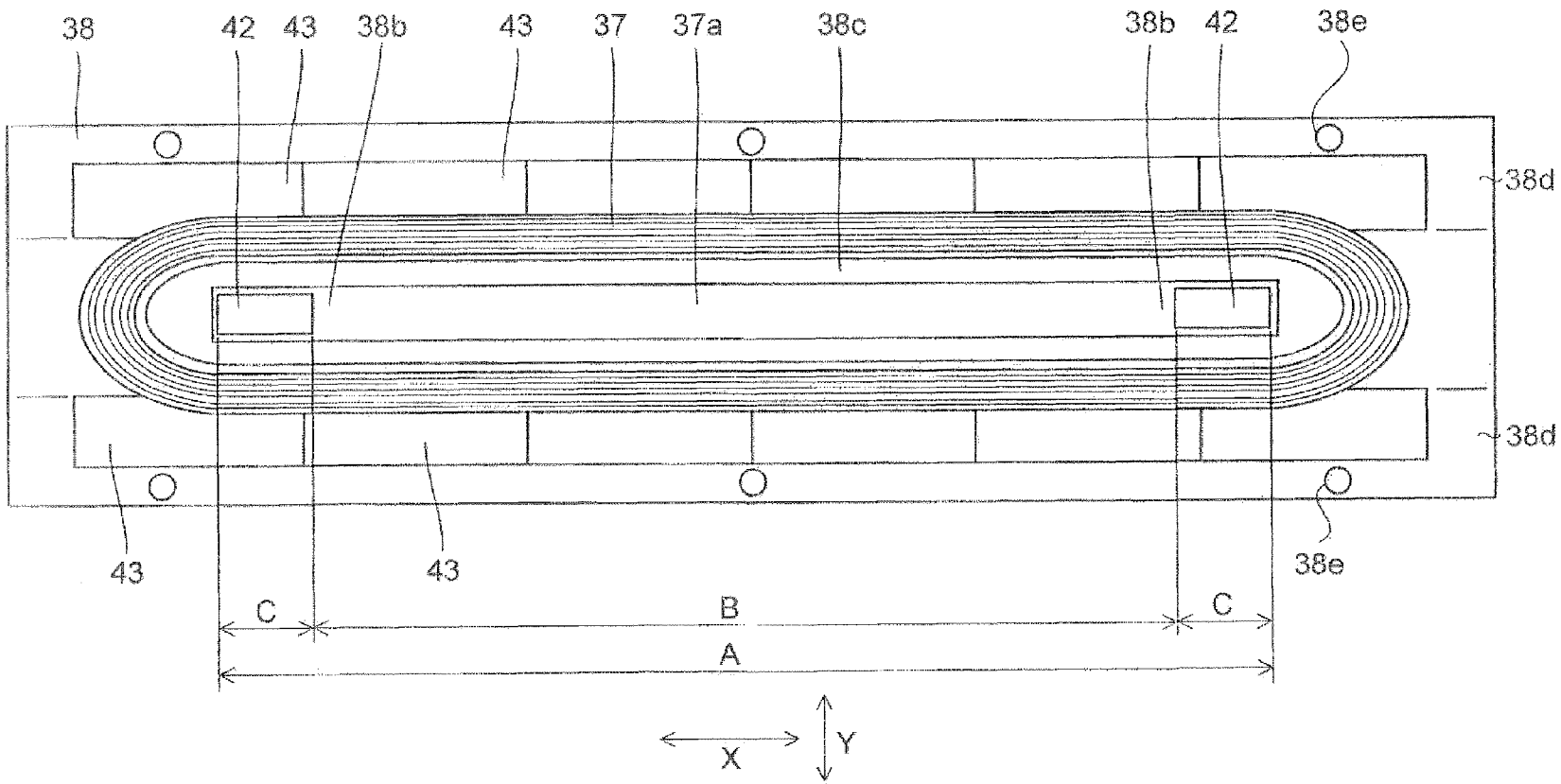
FIG. 5 is a plan view showing the disposition of an end center core of an inductive heating unit according to the first embodiment of the present disclosure.

FIG. 4 and FIG. 5 show the disposition of the coil 37 and the magnetic core 39 in detail. FIG. 4 is a plan view of the arched cores 41 with respect to the arched core holder 45 as seen from below (i.e., from the bobbin 38 side) in FIG. 5 is a plan view showing the disposition of the coil 37, end center core 42, and side core 43 with respect to the bobbin 38 as seen from above (i.e., from the arched core holder 45 side) in FIG. 3.

As shown in FIG. 4, core installation sections 45*b*, in which arched cores 41 are attached at predetermined positions, are formed in the arched core holder 45. A plurality of core installation sections 45*b* is formed at roughly even intervals in the lengthwise direction (i.e., the paper widthwise direction X orthogonal to the paper conveyance direction Y) of the arched core holder 45. Holder apertures 45*c* are formed between adjacent core installation sections 45*b*. A plurality of bolt holes 45*d* into which the bolts 51 (see FIG. 3) for attaching the arched core holder 45 to the bobbin 38 (see FIG. 3) are screwed is formed around the core installation sections 45*b*.

The arched cores 41 are formed from a manganese-zinc alloy-based or other type of high magnetic permeability ferrite so as to have an arched shape with a rectangular cross section. The Curie temperature of the arched cores 41 is at least the temperature of the arched cores 41 when the nip N has reached a fusable temperature. When the temperature of the arched cores 41 is higher than the Curie temperature thereof, the magnetic permeability of the arched cores 41 will decrease sharply, and they will cease to function as magnetic bodies. The plurality of arched cores 41 is encompassed within the length of the coil 37 (FIG. 5) in the lengthwise direction (paper widthwise direction X), and is disposed at uniform intervals along the length of the coil 37 (see FIG. 5) in the lengthwise direction (paper widthwise direction X).

As shown in FIG. 5, the rising wall 38*c* rising from the attachment surface 38*b*, the flanges 38*d*, and a plurality of bolt holes 38*e* into which the bolts 51 (see FIG. 3) are screwed is formed in the bobbin 38. The plurality of side cores 43 is attached to the flanges 38*d*.

The side cores 43 are formed in rectangular shapes from a manganese-zinc alloy-based or other type of high magnetic permeability ferrite, and the Curie temperature thereof is at least the temperature of the side cores 43 when the nip N has reached a fusable temperature. When the temperature of the side cores 43 is higher than the Curie temperature thereof, the magnetic permeability of the side cores 43 will decrease sharply, and they will cease to function as magnetic bodies. A plurality of side cores 43 is disposed on one of the flanges 38*d* of the bobbin 38 in the paper widthwise direction X (hereafter simply "widthwise direction X") with the side surfaces thereof in contact with one another. A plurality of side cores 43 is also disposed on the other flange 38*d* in the widthwise direction X with the side surfaces thereof in contact with one another.

The rising wall 38*c* of the bobbin 38 has wall sections extending in the widthwise direction X and opposing one another, and arcuate wall sections extending into the opposing wall sections and forming an outer edge at both ends in the widthwise direction X.

The outer edge of the rising wall 38*c* has roughly the same shape as a hollow section 37*a* formed within the looped coil 37, and allows the hollow sections 37*a* of the coil 37 to be fitted thereto and the coil 37 to be attached. The inner edge of the rising wall 38*c* forms a rectangular space within which a pair of end center cores 42 is disposed. This rectangular space has a length in the widthwise direction X corresponding to the paper passage area A of the maximum size of fusable paper 9. The rising wall 38*c* has a predetermined thickness so as to keep heat from the excited coil 37 from being radiated or conveyed to the end center cores 42.

A pair of end center cores 42, 42 is attached within the rectangular space of the rising wall 38*c*. The end center cores 42, 42 are disposed so as to oppose an end area C of the paper passage area A of the maximum size of paper 9 when the maximum size of paper 9 passes through the nip N. The end area C is the area formed, for example, to the outside in the widthwise direction X of a central area B formed as a paper passage area when paper 9 of a size smaller than the maximum size of paper 9 passes through the nip N.

The end center cores 42 are formed from a manganese-zinc alloy-based or other type of high magnetic permeability ferrite in a shape as described below. The Curie temperature thereof is at least the temperature of the end center cores 42 when the nip N has reached a fusable temperature. When the temperature of the end center cores 42 is higher than the Curie temperature thereof, the magnetic permeability of the end center cores 42 will decrease sharply, and they will cease to function as magnetic bodies.

Figure 6:
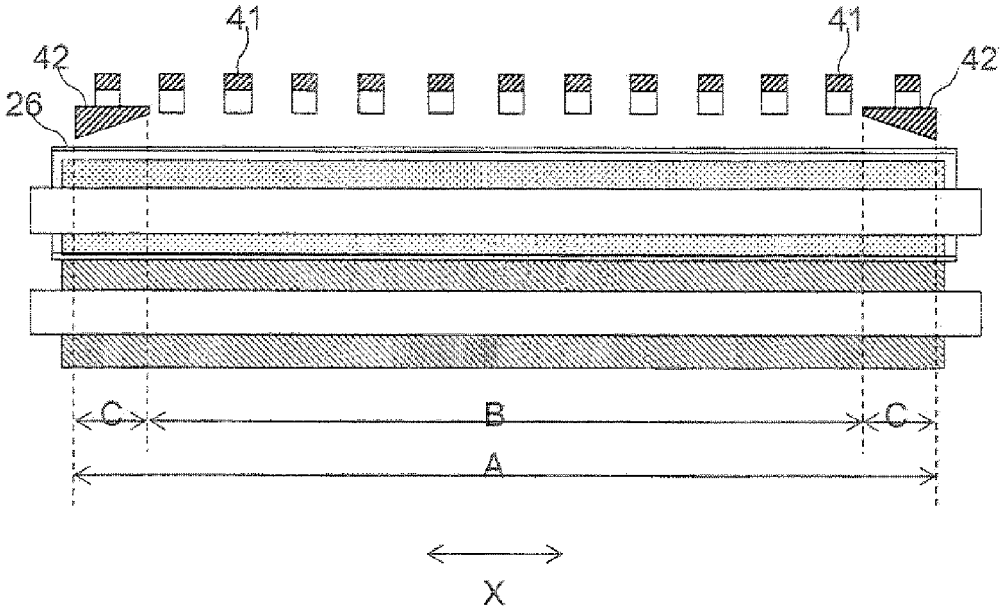
FIG. 6 is a plan view of the configuration of the end center core according to the first embodiment of the present disclosure.
Figure 7:
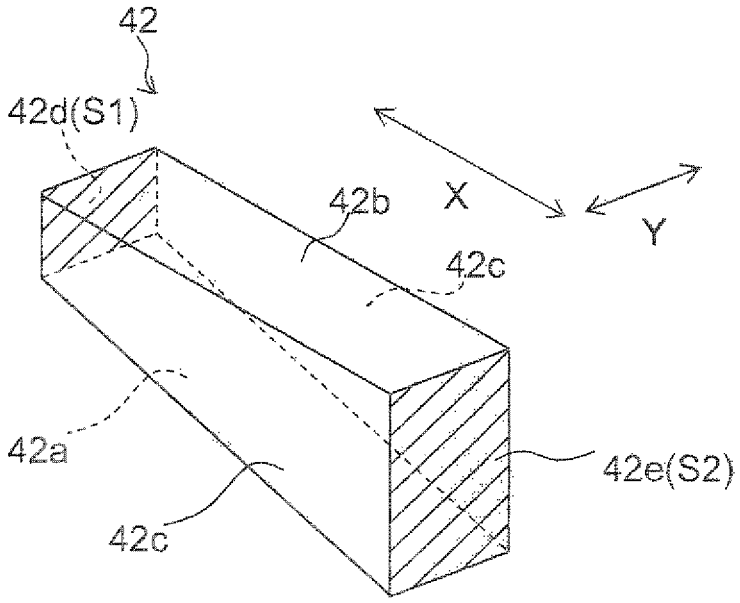
FIG. 7 is a perspective view of the configuration of the end center core according to the first embodiment of the present disclosure.

FIGS. 6 and 7 show the configuration of the end center cores 42 in detail. FIG. 6 is a plan view of the configuration of end center cores 42. FIG. 7 is a perspective illustration of the configuration of the right end center core 42 illustrated in FIG. 6. The right from side of FIG. 7 is the end (outer side) in the widthwise direction X, and the inner left side of FIG. 7 is the center (inner side) in the widthwise direction X. In FIG. 6, the coil 37, bobbin 38, and arched core holder 45 have been omitted for convenience.

As shown in FIG. 6, the end center cores 42 are formed as quadrangular prisms (see FIG. 7) having a pair of trapezoidal faces. As shown in FIG. 7, one end center core 42 has a first surfaces 42*a*, a second surface 42*b*, third surfaces 42*c*, 42*c*, an inner surface 42*d*, and an outer surface 42*e*.

The first surface 42*a* is a surface facing the heat-generating belt 26 (see FIG. 6). The second surface 42*b* is a surface facing the arched core 41 (see FIG. 6), and includes the widthwise direction X and the paper conveyance direction Y. The third surfaces 42*c* are surface facing each other in the paper conveyance direction Y. The inner surface 42*d* is a surface facing the center with respect to the widthwise direction X. The outer surface 42*e* is a surface on the outer end side in the widthwise direction X facing the inner surface 42*d*, and is parallel with the inner surface 42*d*. The inner surface 42*d* is formed in a rectangular shape, and has an inner core surface area S1. The outer surface 42*e* is formed in a rectangular shape and has an outer core surface area S2. The inner surface 42*d* and outer surface 42*e* may be rectangles with the long sides thereof extending in either the vertical or the horizontal direction, or may be squares.

The first surface 42*a* is formed in a rectangular shape. The second surface 42*b* is formed in a rectangular shape. The third surfaces 42*c*, 42*c* are formed in trapezoidal shapes, and face each other in parallel. The first surface 42*a* is disposed inclining in a direction approaching the heat-generating belt 26 (see FIG. 6) from the center side with respect to the widthwise direction X (i.e., the rear left side in FIG. 7) to the end side (i.e., the front right side in FIG. 7). The second surface 42*b* is disposed in parallel to the heat-generating belt 26. Thus, the outer core surface area S2 of the end center core 42 is greater than the inner core surface area S1. The core cross-sectional area of the end center core 42 gradually increases towards the end in the widthwise direction X.

As the core cross-sectional area of the end center cores 42 increases, the end center core 42 gathers more of the magnetic flux generated by the coil 37 (see FIG. 3), and the magnetic flux is guided to the heat-generating belt 26. Thus, the core cross-sectional area of the end center cores 42 gradually increases from the center side with respect to the widthwise direction X toward the other end side, thereby generating an increasingly large amount of heat from the center side with respect to the widthwise direction X to the outer end side by the heat-generating belt 26 during inductive heating.

In the fuser device 5 according to the present embodiment, when fusing a toner image to the maximum size of paper 9, the arched core 41, side core 43, and end center cores 42 are in a state of high magnetic permeability when the coil 37 is electrified and the nip N is maintained at a temperature no greater than the fusable temperature. Thus, in FIG. 3, the magnetic flux generated by the coil 37 follows a magnetic path passing through the inductive heat-generating layer 26*a* of the heat-generating belt 26, the side core 43, and the arched core 41 in the central area B (see FIG. 6). This causes an eddy currents to flow through the inductive heat-generating layer 26*a* of the heat-generating belt 26, and the inductive heat-generating layer 26*a* of the heat-generating belt 26 to generate heat.

Meanwhile, in the end area C (see FIG. 6), the magnetic flux generated by the coil 37 follows a magnetic path passing through the end center core 42, the inductive heat-generating, layer 26*a* of the heat-generating belt 26, the side core 43, wad the arched core 41 in FIG. 3. This causes an eddy current to flow through the inductive heat-generating layer 26*a* of the heat-generating belt 26, and the inductive heat-generating layer 26*a* of the heat-generating, belt 26 to generate heat.

In a fuser device provided with, for example, a coil looped along the lengthwise direction of the heating member and a magnetic core extending along the paper widthwise direction (lengthwise direction) in the gap formed by the rings of the looped coil are provided, the coil being configured so that, for example, an inner part of a U-shaped wrapping part at the end of the lengthwise direction of the coil roughly corresponds to the end of the maximum paper width subjected to fusing, the magnetic core will normally extend to the two ends of the paper width of the maximum paper size. Less magnetic flux will be generated by the coil near the U-shaped wrapping part of the coil than at the other parts of the coil. The heat from the heating member is liable to be released to the outside of the fuser device due to heat radiation or conduction at the two ends in the lengthwise direction of the heating member. For this reason, it is difficult to attain a uniform temperature along the lengthwise direction of the heating member, and the temperature of the two ends of the heating member tends to be lower than the temperature of the center of the heating member. Thus, the temperature at the ends of the paper may be less than the desired fusing temperature even if the center of the paper has reached the appropriate fusing temperature; in such cases, fusion defects such as low temperature offset may occur.

However, the fuser device 5 according to the embodiment of the present disclosure, as described above, allows for satisfactory fusion even at the ends of a recording medium using a simple configuration.

Specifically, in the present embodiment, end center cores 42 are disposed at both ends in the widthwise direction X, causing a large amount of the magnetic flux generated by the coil 37 to be gathered by the end center cores 42 and increasing the amount of heat generated by the heat-generating belt 26 at the ends. Additionally, because the core surface area of the end center cores 42 grows larger towards the end in the widthwise direction X, the end center cores 42 gather increasingly more magnetic flux towards the ends thereof in the widthwise direction X, allowing for a uniform distribution of the magnetic flux density in the widthwise direction of the heat-generating belt 26. For this reason, temperature differences in the widthwise direction of the heat-generating belt 26 are reduced, and fusion defects can be suppressed even at the ends of the paper 9 using the simple feature of varying the cross-sectional area of the end center cores 42 in the widthwise direction X. This enables a good quality image to be obtained.

Specifically, in the fuser device according to the present embodiment, the magnetic flux generated, by the coil passes through a magnetic path formed through the second core section, the inductive heat-generating layer of the heating member, and the first core section in the area at the end of the heating member in the lengthwise direction, resulting in the end area of the heating member being heated. The provision of the second core section allows the second core section to gather the surrounding magnetic flux. Additionally, the fact that the core cross-sectional area of the second core section is formed so as to grow progressively larger from the center of the recording medium with respect to the widthwise direction to the ends allows for the second core section to gather progressively greater amounts of magnetic flux toward the ends of the recording medium with respect to the widthwise direction, allowing for a uniform magnetic flux density distribution in the lengthwise direction of the heating member. Thus, temperature differences in the lengthwise direction of the heating member are reduced, and fusion defects can be suppressed even at the ends of the recording medium using the simple feature of varying the core cross-sectional area of the second core section in the widthwise direction of the recording medium, allowing a good quality image to be obtained.

Second Embodiment

Figure 8:
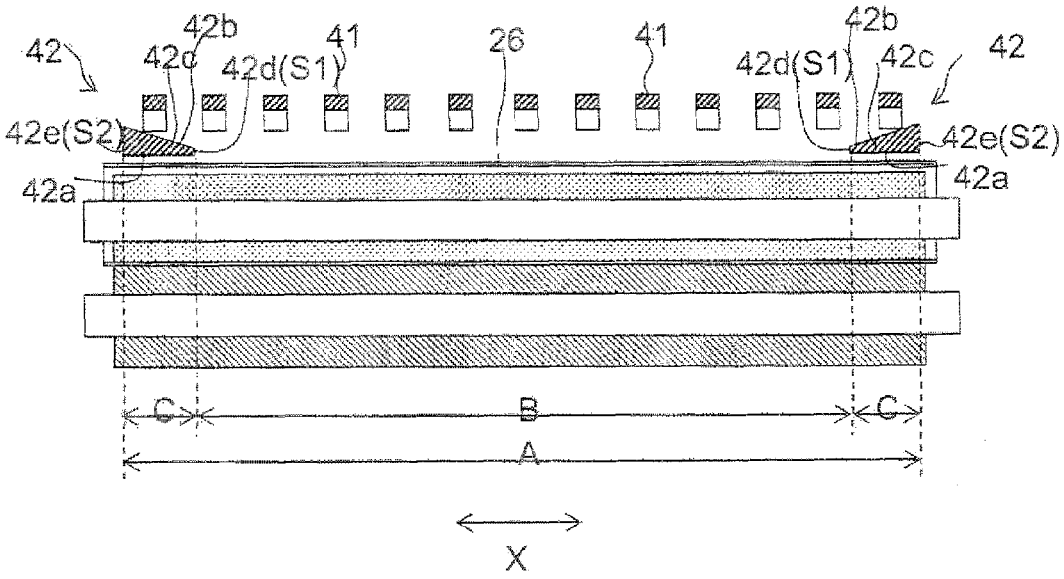
FIG. 8 is a plan view of the configuration of an end center core according to a second embodiment of the present disclosure.

FIG. 8 is a plan view of the configuration of end center cores 42 according to a second embodiment. In FIG. 8, the coil 37, bobbin 38, and arched core holder 45 have been omitted for convenience. In the second embodiment, the shape of die end center cores 42 is different from that of the first embodiment. The following description will focus on the end center cores 42, and a description of parts identical to the first embodiment will be omitted.

Each of the end center cores 42 is a quadrangular prism having a pair of trapezoidal surfaces, and has a first surface 42*a*, a second surface 42*b*, third surfaces 42*c*, 42*c*, an inner surface 42*d*, and an outer surface 42*e*.

The first surface 42*a* is a surface facing the heat-generating belt 26. The second surface 42*b* is a surface facing the arched core 41, and comprises the widthwise direction X and the paper conveyance direction Y. The third surfaces 42*c* are surfaces facing each other in the paper conveyance direction Y. The inner surface 42*d* is a surface facing the center with respect to the widthwise direction X. The outer surface 42*e* is a surface on the outer end side in the widthwise direction X facing the inner surface 42*d*, and is parallel with the inner surface 42*d*. The inner surface 42*d* is formed in a rectangular shape, and has an inner core surface area S1. The outer surface 42*e* is formed in a rectangular shape and has an outer core surface area S2. The inner surface 42*d* and outer surface 42*e* may be rectangles with the long sides thereof extending in either the vertical or the horizontal direction, or may be squares.

The first surface 42*a* is formed in a rectangular shape. The second surface 42*b* is formed in a rectangular shape. The third, surfaces 42*c*, 42*c* are formed in trapezoidal shapes, and face each other in parallel. The first surface 42*a* is disposed in parallel to the heat-generating belt 26. The second surface 42*b* is disposed inclining away from the heat-generating belt 26 from the center side with respect to the widthwise direction X toward the end side. Thus, the outer core surface area S2 of the end center core 42 is greater than the inner core surface area S1. In addition, the core cross-sectional area of the end center core 42 gradually increases from the center side with respect to the widthwise direction X towards the end.

As the core cross-sectional area of the end center cores 42 increases, the end center core 42 gathers more of the magnetic flux generated by the coil 37 (see FIG. 3), and more of the magnetic flux is guided to the heat-generating belt 26. Thus, the core cross-sectional area of the end center cores 42 gradually increases toward the outer end side with respect to the widthwise direction X, thereby generating an increasingly large amount of heat from the center side with respect to the widthwise direction X to the outer end side by the heat-generating belt 26 during inductive heating.

In the fuser device 5 according to the present embodiment end center cores 42 are disposed at both ends in the widthwise direction X, causing a large amount of the magnetic flux generated by the coil 37 to be gathered by the end center cores 42 and increasing the amount of heat generated by the heat-generating belt 26 at the ends. Additionally, because the core surface area of the end center cores 42 grows larger from the center towards the end in the widthwise direction X, the end center cores 42 gather increasingly more magnetic flint from the center towards the ends thereof in the widthwise direction X, allowing for a uniform distribution of the magnetic flux density in the widthwise direction of the heat-generating belt 26. For this reason, temperature differences in the widthwise direction X of the heat-generating belt 26 may be reduced, and fusion defects can be suppressed even at the ends of the paper 9 using the simple feature of varying the cross-sectional area of the end center cores 42 in the widthwise direction X. This enables a good quality image to be obtained.

Third Embodiment

Figure 9:
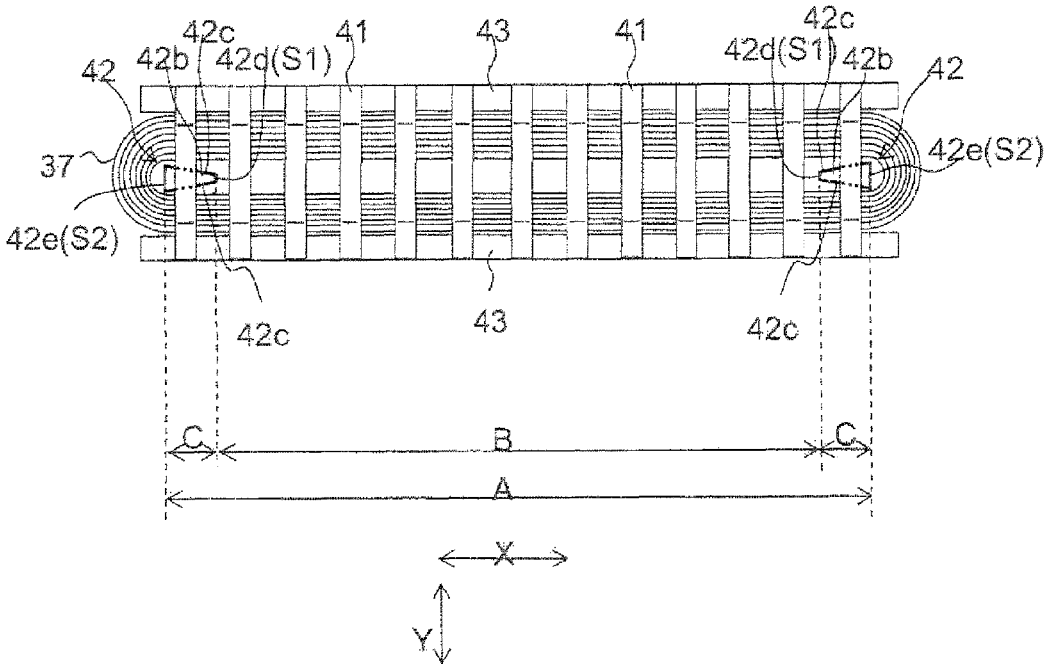
FIG. 9 is a plan view of the configuration of an end center core according to a third embodiment of the present disclosure.

FIG. 9 is a plan view of the configuration of an end center core 42 according to a third embodiment as seen from above in FIG. 3. In the third embodiment, the shape of the end center cores 42 is different from that of the cores of the first and second embodiments. In FIG. 9, the bobbin 38 and arched core holder 45 have been omitted for convenience.

Each of the end center cores 42 is a quadrangular prism having a pair of trapezoidal surfaces, and has a first surface 42*a* (the bottom surface facing the second surface 42*b*; not visible in FIG. 9), a second surface 42*b*, third surfaces 42*c*, 42*c*, an inner surface 42*d*, and an outer surface 42*e*.

The first surface 42*a* is a surface facing the heat-generating belt 26 (see FIG. 3). The second surface 42*b* is a surface facing the arched core 41, and comprises the widthwise direction X and the paper conveyance direction Y. The third surfaces 42*c* are surfaces facing each other in the paper conveyance direction Y. The inner surface 42*d* is a surface facing the center with respect to the widthwise direction X. The outer surface 42*e* is a surface on the outer end side in the widthwise direction X facing the inner surface 42*d*, and is parallel with the inner surface 42*d*. The inner surface 42*d* is formed in a rectangular shape, and has an inner core surface area S1. The outer surface 42*e* is formed in a rectangular shape and has an outer core surface area S2. The inner surface 42*d* and outer surface 42*e* may be rectangles with the long sides thereof extending in either the vertical or the horizontal direction, or may be squares.

The first surface 42*a* and second surface 42*b* are trapezoidal surfaces disposed in parallel to the heat-generating belt 26. The third surfaces 42*c*, 42*c* are rectangular surfaces disposed facing one another so as to be positioned progressively farther apart from each other from the center side with respect to the widthwise direction X toward the end side. Thus, the outer core surface area S2 of the end center core 42 is greater than the inner core surface area S1. In addition, the core cross-sectional area of the end center core 42 gradually increases front the center side with respect to the widthwise direction X towards the end.

As the core cross-sectional area of the end center cores 42 increases, the end center core 42 gathers more of the magnetic flux generated by the coil 37 (see FIG. 3), and the magnetic flux is guided to the heat-generating belt 26. Thus, the core cross-sectional area of the end center cores 42 grows progressively larger in the widthwise direction X, causing the amount of heat generated to increase toward the ends of the heat generating belt 26.

In the fuser device 5 according to the present embodiment, end center cores 42 are disposed at both ends in the widthwise direction X, causing a large amount of the magnetic flux generated by the coil 37 to be gathered by the end center cores 42 and increasing the amount of heat generated by the heat-generating belt 26 at the ends. Additionally, because the core surface area of the end center cores 42 grows larger from the center towards the end in the widthwise direction X, the end center cores 42 gather increasingly more magnetic flux from the center towards the ends thereof in the widthwise direction X, allowing for a uniform distribution of the magnetic flux density in the widthwise direction of the heat-generating belt 26. For this reason, temperature differences in the widthwise direction of the heat-generating belt 26 may be reduced, and fusion defects can be suppressed even at the ends of the paper 9 using the simple feature of varying the cross-sectional area of the end center cores 42 in the widthwise direction X. This enables a good quality image to be obtained.

The first surface 42*a* of the end center core 42 is disposed inclined with respect to the heat-generating belt 26 in the first embodiment described above, and the second surface 42*b* is disposed inclined with respect to the heat-generating belt 26 in the second embodiment, but the present disclosure is not limited to this. For example, if the core cross-sectional area of the end center cores 42 grows larger toward the end with respect to the widthwise direction X, both the first surface 42*a* and the second surface 42*b* may be inclined with respect to the heat-generating belt 26. The pair of third, surfaces 42*c*, 42*c*, along with the first surface 42*a* and the second surface 42*b*, may also be disposed facing each other so as to be positioned progressively farther apart from each other from the center side with respect to the widthwise direction X toward the end side.

In the embodiments described above, the end center cores 42 are quadrangular prisms, but not by way of limitation in the present disclosure. For example, a configuration in which at least one surface extending in the widthwise direction X of another type of polygonal prism is inclined with respect to the heat-generating belt 26 is acceptable, or a cylindrical shape is also acceptable.

In the embodiments described above, the arched core 41 and the side core 43 were provided separately, but not by way of limitation in the present disclosure; a configuration in which the arched core 41 is further extended toward the side core 43 side and the arched core 41 tales over the functions of the side core 43 is also acceptable.

In the embodiments described above, the arched core 41 is attached to the bobbin 38 with the arched core holder 45 interposed therebetween, but not by way of limitation in the present disclosure; the arched core 41 may also be directly attached to the bobbin 38.

In the embodiments described above, examples of the disclosure being applied at a fuser device 5 is which the heat-generating belt 26 is held in a tensed state around the fusing roller 18 have been given, but not by way of limitation in the present disclosure the disclosure may also be applied to a fuser device in which an endless heat-generating belt is held in a tensed state between a heat roller disposed so as to face a inductive heating unit and a fusing roller pressed against a pressure-applying roller. The present disclosure may also be applied to a fuser device provided with an inductive heating unit for heating an endless heat-generating belt; a pressure-applying roller pressed against the outer circumferential surface of the heat-generating belt; and a pressing member, disposed on the inner circumferential surface of the heat-generating belt, for pressing the paper and the heat-generating belt together against the pressure-applying roller. The present disclosure may also be applied to various types of fuser devices provided with inductive heating units, such as a fuser device provided with a pressure-applying roller and a heating roller pressed against the pressure-applying roller, the heating roller containing an inductive heat-generating layer within itself and is disposed facing an inductive heating unit.

Working examples 1-3 representing more concrete embodiments of the present disclosure and comparative examples 1 and 2 will be described hereafter. The present disclosure is not limited to the following working examples.

Working examples 1-3 including fuser devices 5 utilizing electromagnetic induction heating according to the first embodiment provided with end center cores 42 of different shapes or not provided with end center cores 42, as well as comparative examples 1 and 2, were tested, and the temperature distributions in the lengthwise direction of the heat-generating belts 26 were evaluated.

The heat-generating belts 26 used in the laser devises 5 subjected to testing had inner diameters of 35 mm and lengths in the lengthwise direction of 340 mm. The inductive heat-generating layers 26*a* were formed from electroformed nickel to a thickness of 40 μm. The elastic layers 26*b* were formed from silicone rubber to a thickness of 200 μm. The mold release layers 26*c* were formed from 30 μm-thick fluororesin tubing.

Rollers having elastic layers 18*b* of 9 mm-thick foamed silicone rubber over metal cores 18*a* of an aluminum alloy were used for the fusing rollers 18. The rollers used for the pressure-applying rollers 19 had outer diameters of 30 mm, and had elastic layers 19*b* of 5 mm-thick foamed silicone rubber over metal cores 19*a* of iron, as well as 50 μm-thick mold release layers 19*c* formed from fluororesin tubing over elastic layers 19*b*.

The coils 37 were looped a plurality of times in the lengthwise direction to a length of 370 mm. Arched cores 41, end center cores 42, and side cores 43 formed from ferrite were used.

The fusing load was set to 300 N (150 N per side×2), the heat-generating belt 26 was driven to rotate at an outer circumference speed of 270 mm/sec, and the center of the heat-generating belt 26 in the lengthwise direction was made to generate heat at 175° C.

Figure 10A:
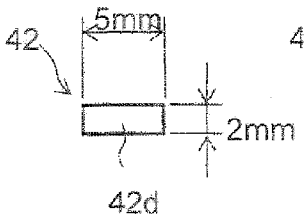
FIG. 10A is an illustration of the shape of the inner surface of an end center core according to a first working example of the present disclosure.
Figure 10B:
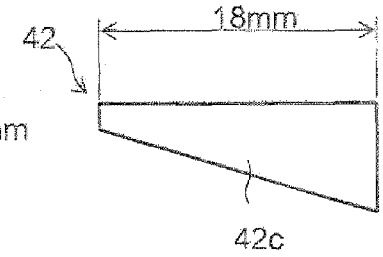
FIG. 10B is a plan view of the shape of the end center cons according to the first working example of the present disclosure.
Figure 10C:
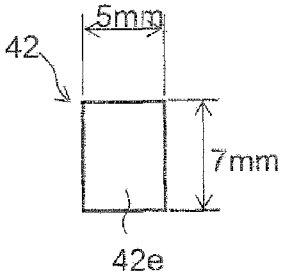
FIG. 10C is an illustration of the shape of the outer surface of the end center core according to the first working example of the present disclosure.
Figure 11A:
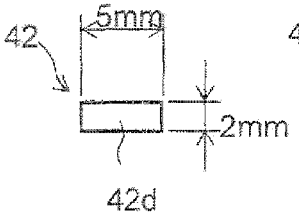
FIG. 11A is an illustration of the shape of the inner surface of an end center core according to a second working example of the present disclosure.
Figure 11B:
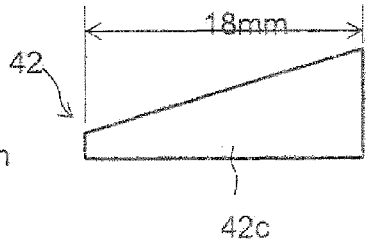
FIG. 11B is a plan view of the shape of the end center core according to the second working example of the present disclosure.
Figure 11C:
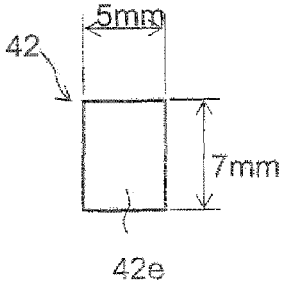
FIG. 11C is an illustration of the shape of the outer surface of the end center core according to the second working example of the present disclosure.
Figure 12A:
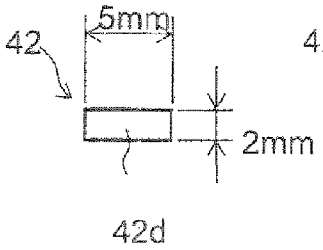
FIG. 12A is an illustration of the shape of the inner surface of an end center core according to a third working example of the present disclosure.
Figure 12B:
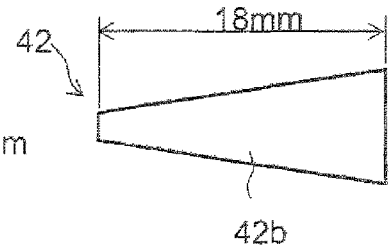
FIG. 12B is a plan view of the shape of the end center core as seen from above according to the third working example of the present disclosure.
Figure 12C:
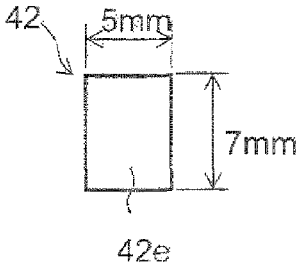
FIG. 12C is an illustration of the shape of the outer surface of the end center core according to the third working example of the present disclosure.
Figure 13A:
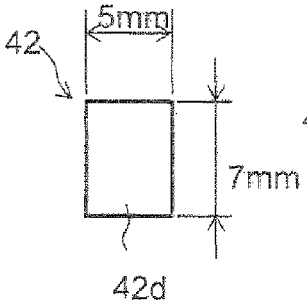
FIG. 13A is an illustration of the shape of the inner surface of an end center core according to a second comparative example of the present disclosure.
Figure 13B:
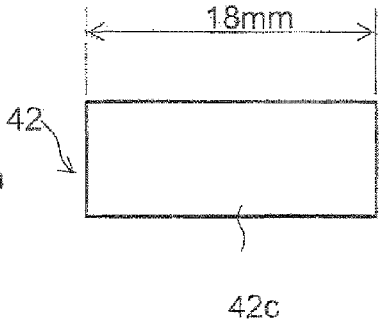
FIG. 13B is a plan view of the shape of the end center core accordingly the second comparative example of the present disclosure.
Figure 13C:
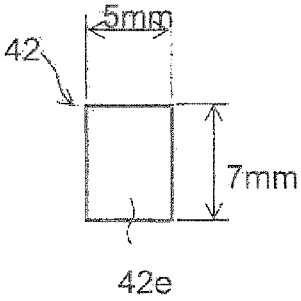
FIG. 13C is an illustration of the shape of the outer surface of the end center core according to the second comparative example of the present disclosure.

End center cores 42 according to working examples 1-3 and comparative example 2 were attached to a fuser device 5 having the specifications described above at predetermined positions on both ends in the widthwise direction X of the bobbin 38. FIGS. 10A-43C show the shapes of the end center cores 42. FIGS. 10A-10C show the shape of the end center cores 42 in working example 1. FIGS. 11A-11C show the shape of the end center cores 42 in working example 2. FIGS. 12A-12C show the shape of the end center cores 42 in Working example 3. FIGS. 13A-13C show the shape of the end center cores 42 in comparative example 2. Comparative example 1 is not illustrated as it was not provided with end center cores 42. FIGS. 10A, 11A, 12A, and 13A show the inner surface 42*d* of the end center core 42. FIGS. 10B, 11B, 12B, and 13B show a plan view of the end center core 42 (12B being a plan view is seen from above). FIGS. 10C, 11C, 12C, and 13C show the outer surface 42*e* of the end center core 42. The lengths of each side of the end center core 42 were as shown is the drawings.

Working example 1 had a shape-corresponding to the first embodiment, working example 2 corresponding to the second embodiment, and working example 3 corresponding to the third embodiment. The core surface area S1 of the inner surface 42*d* for each of working examples 1-3 was 10 $mm^2$, and the core surface area of the outer surface 42*e* was 35 $mm^2$. Meanwhile, comparative example 1, as described above, is an example not provided with end center cores 42. Comparative example 2 used rectangular end center cores 42, the core surface area S1 of the inner surface 42*d* thereof being 35 $mm^2$, and the core surface area of the outer surface 42*e* being 35 $mm^2$.

Figure 14:
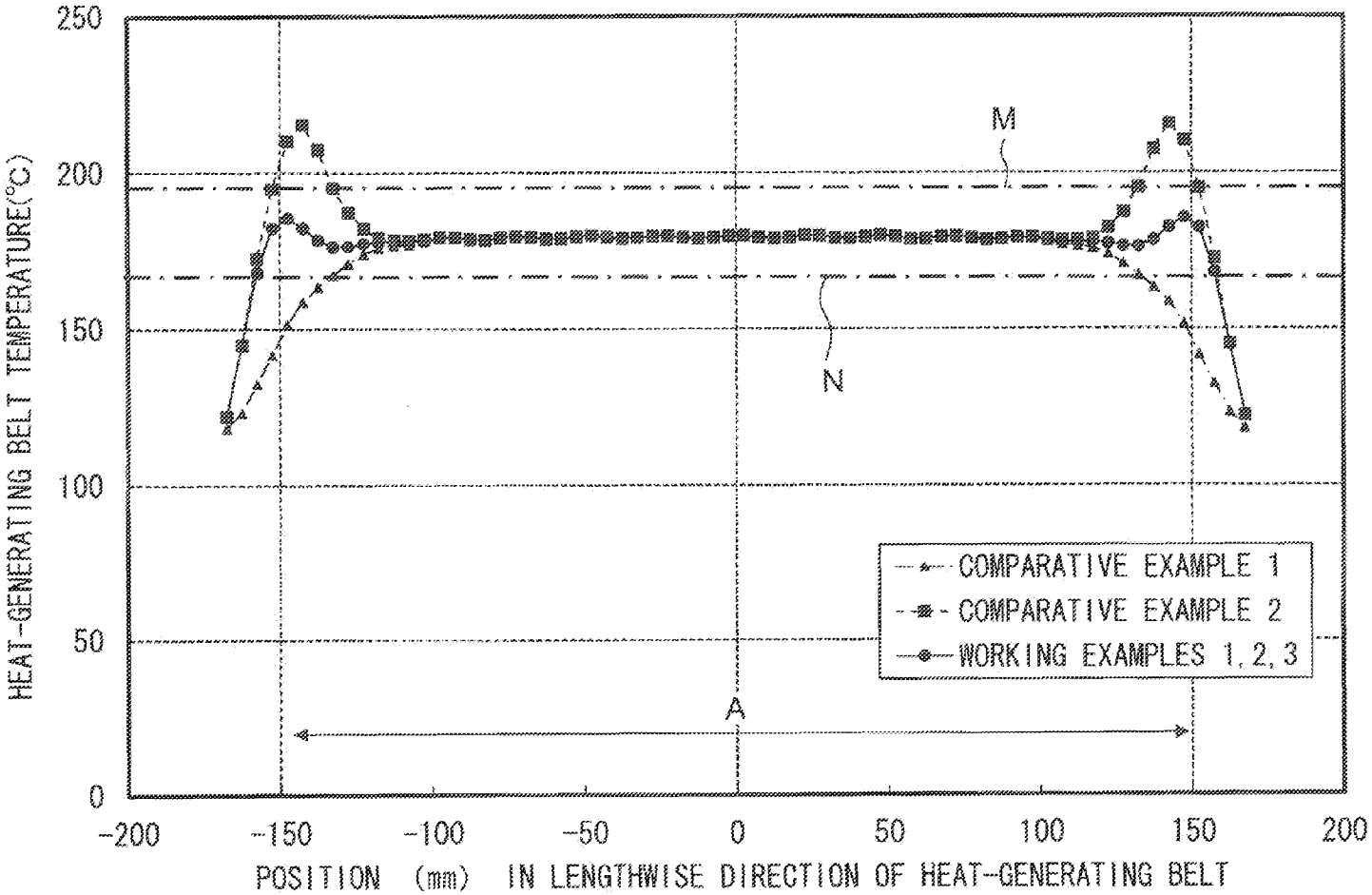
FIG. 14 is an illustration of the temperature distribution of the heating members according to the working and comparative examples of the present disclosure.

FIG. 14 shows the temperature distribution of the heat-generating belt 26 when fusing is performed upon the maximum size of paper. The horizontal axis of the graph in FIG. 14 shows the position of the heat-generating belt 26 in the lengthwise direction (in millimeters) in the paper passage area A of the maximum size of paper, and the vertical axis shows the temperature (° C.) of the heat-generating belt 26. The position in the lengthwise direction of the horizontal axis is the length based on the center position of the heat-generating belt 26. Line M in FIG. 14 indicates the minimum temperature at which fusing defects due to high-temperature offset can occur, and line N indicates the maximum temperature at which fusing defects due to low-temperature offset can occur. The evaluation results for working examples 1-3 and comparative examples 1 and 2 are shown in Table 1. In Table 1, ○ indicates no fusing problems, and X indicates the occurrence of a fusing defect due to low-temperature offset or high-temperature offset.

TABLE 1

| | Working Example 1 | Working Example 2 | Working Example 3 | Comparative Example 1 | Comparative Example 2 |
|---|---|---|---|---|---|
| Center of paper | ○ | ○ | ○ | ○ | ○ |
| Ends of paper | ○ | ○ | ○ | X | X |

As shown in FIG. 14 and Table 1, the temperature at the ends of the paper passage area A in comparative example 1 was 155° C., and a fusing defect occurred due to low-temperature offset. The temperature at the ends of the paper passage area A in comparative example 2 was 210° C., and a fusing defect occurred due to high-temperature offset. Meanwhile, in working example 1, the temperature at the ends of the paper passage area A was 185° C., and there were no fusing problems. Nearly the same results were obtained for working examples 2 and 3, and there were no fusing problems.

The present disclosure can be used for a fuser device used in a photocopier, printer, fax machine, a multifunction machine combining these functions, or the like, and for an image forming apparatus provided with the same. In particular, the present disclosure can be used for a fuser device utilizing electromagnetic induction heating and an image forming apparatus provided with the same.

What is claimed is:

1. A fuser device comprising:

a heating member;

a pressure-applying member configured to clamp, in a space bounded on one side by the heating member, a recording medium that bears an unfused toner image, and to form a nip where the unfused toner image on the recording medium is melted and fused, by causing the pressure-applying member to press against the heating member;

a coil for generating a magnetic flux for inductively heating the heating member, the coil being looped around the heating member along the lengthwise direction thereof; and a magnetic core, disposed near the coil, configured to guide the magnetic flux to the inductive heat-generating layer of the heating member, the core having:

a first core section surrounding the coil and disposed along the widthwise direction of the recording medium orthogonally to the direction of conveyance of the recording medium; and a second core section disposed only at both ends in the widthwise direction within a hollow area which the loop of the coil forms, the second core section being formed so that the cross-sectional area thereof in the conveyance direction of the recording medium grows progressively larger from the center of the widthwise direction towards the ends, wherein the second core section is an only magnetic member provided inside the hollow area.

2. The fuser device according to claim 1, wherein the second core section being formed in the shape of a quadrangular prism; and having a first surface facing the heating member, a second surface facing the first core section and including the conveyance and widthwise directions of the recording medium, and a pair of trapezoidally formed third surfaces facing each other in the conveyance direction of the recording medium;

the first surface being disposed inclining in a direction approaching the heating member from a center side in the widthwise direction toward an end side; and the second surface being disposed parallel to the heating member.

3. The fuser device according to claim 1, wherein the second core section being formed in the shape of a quadrangular prism; and having a first surface facing the heating member, a second surface facing the first core section and including the conveyance and widthwise directions of the recording medium, and a pair of trapezoidally formed third surfaces facing each other in the conveyance direction of the recording medium;

the first surface being disposed parallel to the heating member; and the second surface being disposed inclining in a direction moving away from the heating member from a center side in the widthwise direction toward an end side.

4. The fuser device according to claim 1, wherein the second core section being formed in the shape of a quadrangular prism; and having a first surface facing the heating member, a second surface facing the first core section and including the conveyance and widthwise directions of the recording medium, and a pair of trapezoidally formed third surfaces facing each other in the conveyance direction of the recording medium;

the first surface being disposed inclining in a direction approaching the heating member from a center side in the widthwise direction toward an end side; and the second surface being disposed inclining in a direction moving away from the heating member from a center side in the widthwise direction toward an end side.

5. The fuser device according to claim 1, wherein the second core section being formed in the shape of a quadrangular prism; and having a first surface facing the heating member, a second surface facing the first core section and including the conveyance and widthwise directions of the recording medium, and a pair of third surfaces facing each other in the conveyance direction of the recording medium;

the first and second surfaces having trapezoidal shapes, and being disposed parallel to the heating member; and the pair of third surfaces having rectangular shapes and being disposed so as to be positioned progressively farther apart from each other from a center side with respect to the widthwise direction toward an end side.

6. The fuser device according to claim 1, wherein being further provided with a support member facing the surface of the heating member; and the second core section being attached to an attachment surface on a side opposite to a surface of the support member facing the heating member.

7. The fuser device according to claim 1, wherein the heating member comprising an endless belt held in a tensed state over a fusing roller so as to be integrally rotatable therewith; and the pressure-applying member comprising a pressure-applying roller pressed against the heating member.

8. An image forming apparatus provided with an image forming unit configured to electrolithographically form a toner image on a recording medium, and a fuser device configured to melt and fuse the toner image formed on the recording medium to the recording medium;

the fuser device comprising:

a heating member;

a pressure-applying member for clamping, in a space bounded on one side by the heating member, a recording medium that bears an unfused toner image, and forming a nip where the unfused toner image on the recording medium is melted and fused, by causing the pressure-applying member to press against the heating member;

a coil for generating a magnetic flux for inductively heating the heating member, the coil being looped around the heating member along the lengthwise direction thereof; and a magnetic core, disposed near the coil, for guiding the magnetic flux to the inductive heat-generating layer of the heating member, the core comprising:

a first core section surrounding the coil and disposed in the widthwise direction of the recording medium orthogonally to the direction of conveyance of the recording medium; and a second core section disposed only at both ends in the widthwise direction within a hollow area which the loop of the coil forms, the second core section being formed so that the cross-sectional area thereof in the conveyance direction of the recording medium grows progressively larger from the center of the widthwise direction towards the ends, wherein the second core section is an only magnetic member provided inside the hollow area.

* * * * *